US008498433B1

(12) United States Patent
Lund et al.

(10) Patent No.: US 8,498,433 B1
(45) Date of Patent: Jul. 30, 2013

(54) SONIC MOTION APPARATUS

(75) Inventors: Bruce D. Lund, River Forest, IL (US); Michael D Starrick, Maywood, IL (US); Guruge Weerauppulige, Forest Park, IL (US)

(73) Assignee: Lund and Company Invention, LLC, River Forest, IL (US)

( * ) Notice: Subject to any disclaimer, the term of this patent is extended or adjusted under 35 U.S.C. 154(b) by 973 days.

(21) Appl. No.: 12/497,794

(22) Filed: Jul. 6, 2009

(51) Int. Cl.
*H04R 25/00* (2006.01)

(52) U.S. Cl.
USPC ..... 381/162; 381/178; 310/322; 181/143

(58) Field of Classification Search
USPC ..... 381/71.2, 162, 164, 178, 191; 310/81, 310/328, 323.01, 330, 323.17, 323.03, 323.06, 310/322; 446/3, 65; 463/65, 69; 181/141, 181/143, 161–163; 185/38, 39; 367/180
See application file for complete search history.

(56) References Cited

U.S. PATENT DOCUMENTS

| | | | | |
|---|---|---|---|---|
| 853,732 | A | 5/1907 | Pearson | |
| 2,392,547 | A | 1/1946 | Plebanek | |
| 2,400,261 | A | 5/1946 | Plebanek | |
| 2,811,809 | A | 11/1957 | Di Franco | |
| 3,196,580 | A | 7/1965 | Rakestraw | |
| 4,882,500 | A * | 11/1989 | Iijima | 310/323.06 |
| 5,679,047 | A | 10/1997 | Engel | |
| 2006/0125336 | A1 * | 6/2006 | Treat | 310/81 |
| 2009/0107772 | A1 | 4/2009 | Lund | |
| 2009/0311941 | A1 | 12/2009 | Bickerton | |
| 2009/0320978 | A1 * | 12/2009 | Martinez | 150/132 |

* cited by examiner

*Primary Examiner* — Vivian Chin
*Assistant Examiner* — Friedrich W Fahnert
(74) *Attorney, Agent, or Firm* — Jack Shore; Much Shelist

(57) ABSTRACT

The instant development relates to utilizing the sonic motion generated by a speaker to move objects in various directions in response to the variation in the frequency and amplitude of the sonic vibrations. This can be used to move objects in a linear and/or rotating manner. This is accomplished by the utilization of directionality oriented members.

16 Claims, 10 Drawing Sheets

Fig 2A
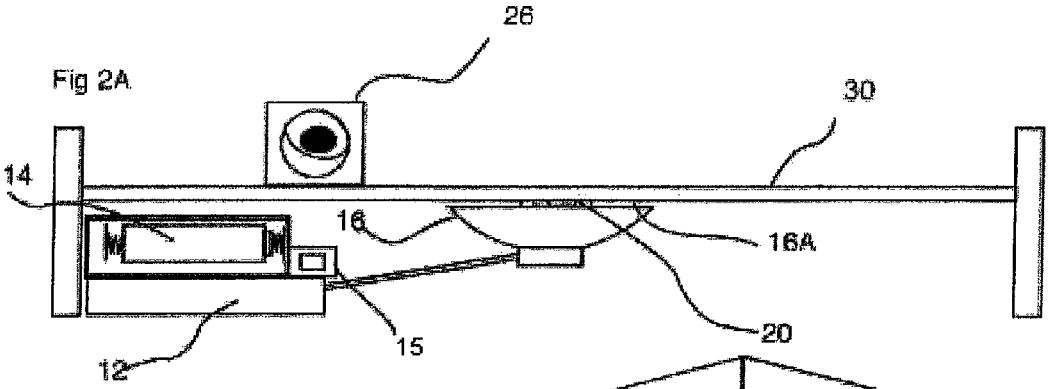
Fig 2B
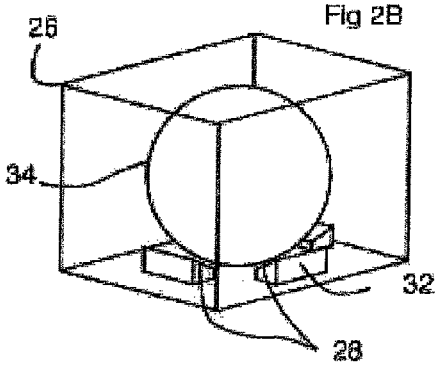
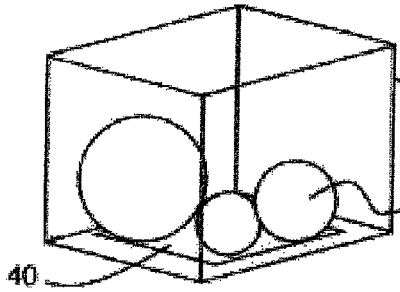
Fig 2C
Fig 2E'
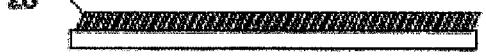
Fig 2D
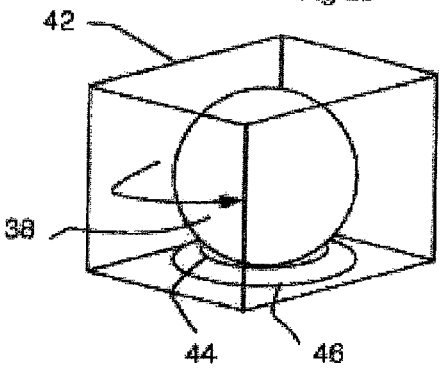
Fig 2E
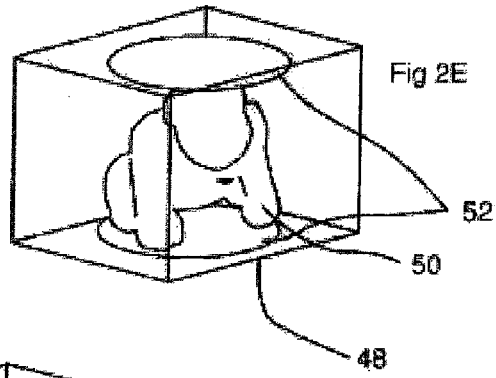
Fig 2F
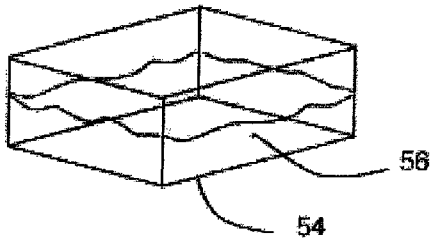

Fig 3A
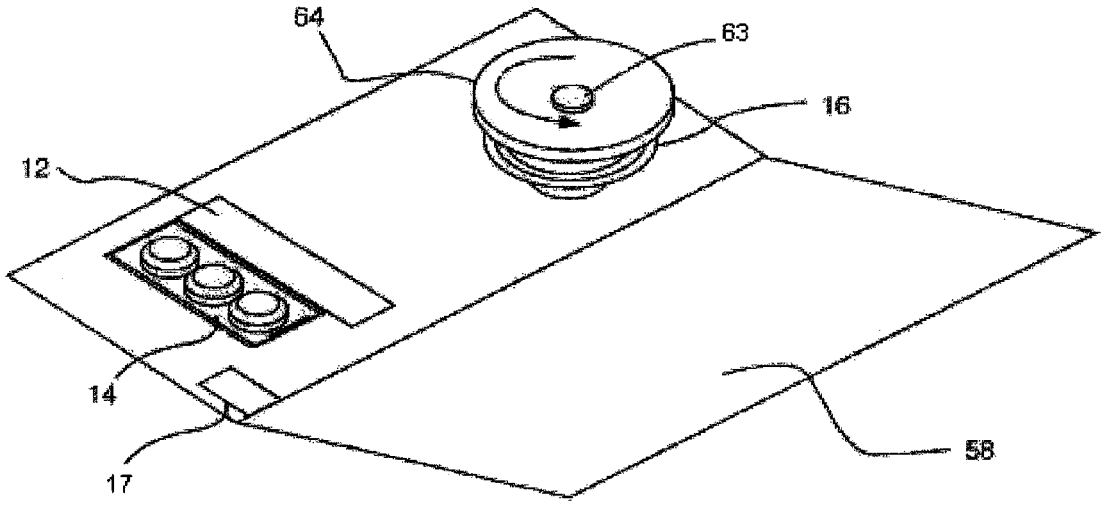
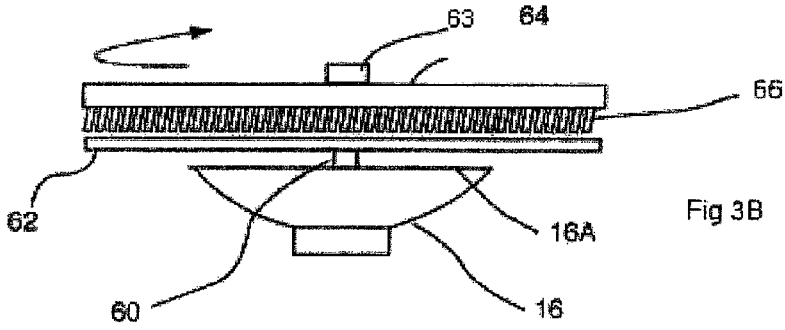
Fig 3B

Fig 7A
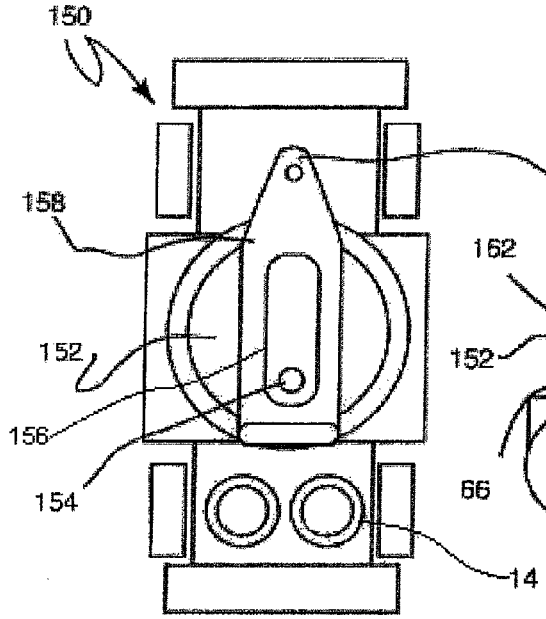
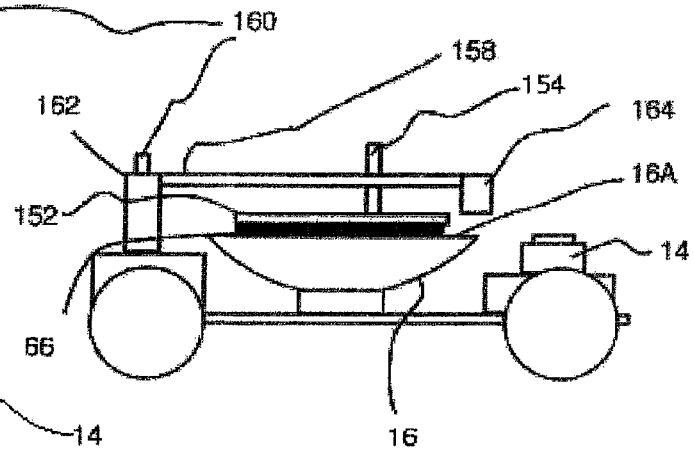
Fig 7B
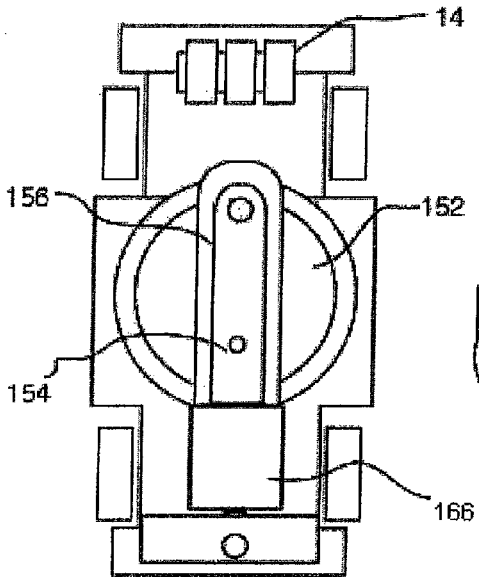
Fig 7C
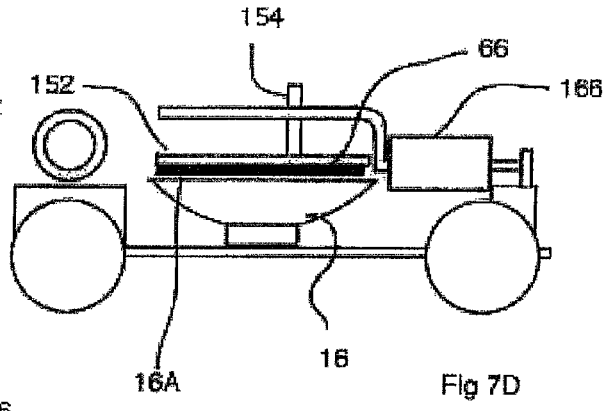
Fig 7D

SONIC MOTION APPARATUS

FIELD OF THE INVENTION

The present invention relates to a device that brings about various types of motion to a multitude of toys or other products that are generated by the sonic movement of a membrane directly or indirectly created by a variable or steady sound system.

Variations in the amplitude and frequency of the sound will vary the speed and movement of the objects placed in a position to respond to the sonic variation.

BACKGROUND OF THE INVENTION

It has been common practice to vary the movement and positioning of various toys or other products by making them responsive to the movement of gears, shafts, linkages, etc. all of which require a motor for operating them.

It has long been desired to operate toys and other products without the necessity of a motor.

DESCRIPTION OF THE INVENTION

The present invention relates to devices that utilize sound generated through the action of a microprocessor or other device that can be programmed to generate sounds through a speaker or other vibrating source having a varying or steady frequency or amplitude to vary the speed and/or movement of an object placed in direct or indirect contact with a speaker diaphragm or the like that is energized by sound waves. This can be accomplished by placing an object on a speaker diaphragm surface that directly moves the object placed thereon or by placing the object to be moved on a support plate that is connected to the speaker diaphragm to move in accordance therewith. Through the use of directional members located on the bottom of the item being moved or on a member adjacent to the item to be moved by direct or indirect contact with the speaker the item will respond to the sound waves to move in a rotary and/or forward direction.

A programmed microprocessor or a radio are two ways that the sonic motion can be accomplished.

An object to be moved in response to sound waves can, by way of example, in addition to a speaker diaphragm or plate connected thereto, be placed on the speaker of a cell phone, or at the outlet of a microphone or musical instrument. Essentially, in accordance with the invention, an object can be operated by the sonic motion created where sound waves are emitted. The particular movement of the object in question can, in one instance, be controlled by directional members located on the bottom of the object being moved and subjected to the sound waves imparted against the directional members or conversely the directional members can be located on the sound imparting element to act upon the object in question.

DESCRIPTION OF THE DRAWINGS

FIG. 2A is a cross-sectional view showing a cube in position to be operated by the sonic actions of the speaker;

FIG. 2B shows a second embodiment of a hollow cube containing a ball that is activated within the cube;

FIG. 2C shows a hollow cube containing a plurality of spheres within a hollow cube energized by the sonic motion of a speaker.

FIG. 2D is a hollow cube containing a sphere that is rotated within the cube;

FIG. 2E is a hollow cube that contains a figure that is rotated within the cube by the sonic vibrations;

FIG. 2F shows a hollow cube containing water that is moved within the cube by sonic vibrations;

FIG. 3A illustrates an open card or book which when opened will emit sounds and activate a vibrating disc;

FIG. 3B illustrates a detail of the speaker and disc interaction;

FIG. 7A is a plan view of a hot wheels vehicle assembly having eyes that are moved in response to the movements of a speaker diaphragm;

FIG. 7B is a side view of the vehicle assembly of FIG. 7A;

FIG. 7C is plan view of a hot wheels vehicle assembly in which the engine is tilted from side to side in response to the movements of a speaker diaphragm;

FIG. 7D is a side view of the vehicle assembly of FIG. 7C

FIG. 8B is a front view of the disc 64.

DESCRIPTION OF THE DRAWINGS

Figure 1A:
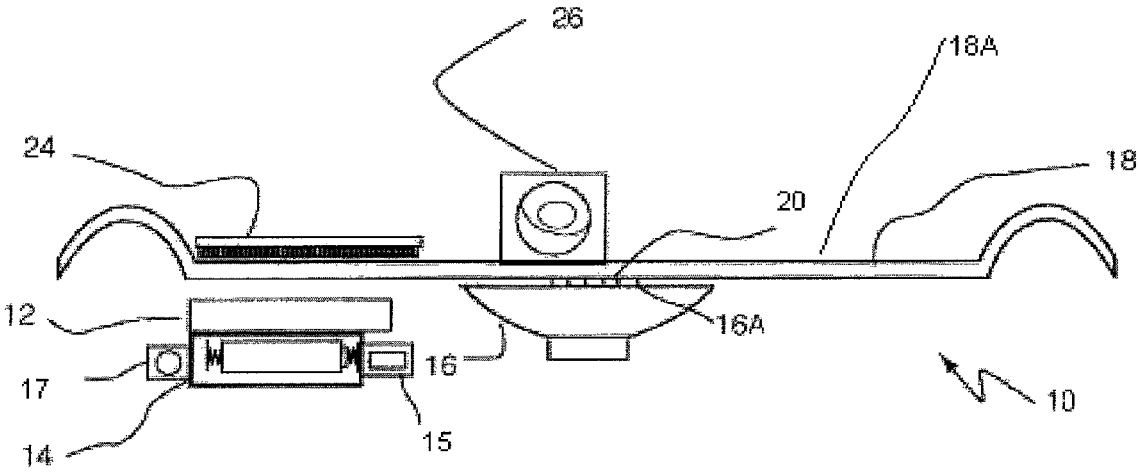
FIG. 1A is a cross-sectional view of a sonically operated assembly consisting of a speaker and its components for activating objects located on a tray moved by the speaker diaphragm.
Figure 1A:
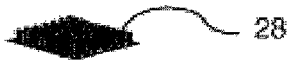

Referring to FIG. 1A there is illustrated a cross sectional view of a sonic motion mechanism 10. A microprocessor electronics package 12 is utilized that is supplied current from a battery pack 14. Current from the battery pack 14 for the microprocessor electronics package 12 can be controlled by an on/off switch 15 or a momentary contact switch 17. The microprocessor electronics package 12 sends a signal to the speaker 16 that causes the speaker diaphragm 16A to create vibrations in the tray 18 and produce sound for the enjoyment of the user as well as a mechanical movement of the tray that acts to move various items in direct or indirect contact with the diaphragm surface 16A.

As shown in FIG. 1A the speaker 16 is connected by a speaker tray connector 20 to the tray such as a high chair tray 18 that vibrates in response to the sonic waves created by the speaker 16. A child can place various items on the high chair vibrating tray surface 18A to observe the actions of the items placed on the vibrating tray 18 such as a rotating disc 24 or a lateral action cube 26. These are but a few of the examples of objects that when placed on the tray can spin and/or move laterally in response to the sonic motion imparted by the speaker 16. The rotating disc 24 can impart rotation to a shaft connected thereto that alone or through a gear mechanism can drive a wide variety of items. Other examples, some of which will be described later include juvenile merchandise, talking books, greeting cards, sound action dolls, christmas ornaments, game spinner or a fan blade to dispense air freshener scents.

Figure 1B:
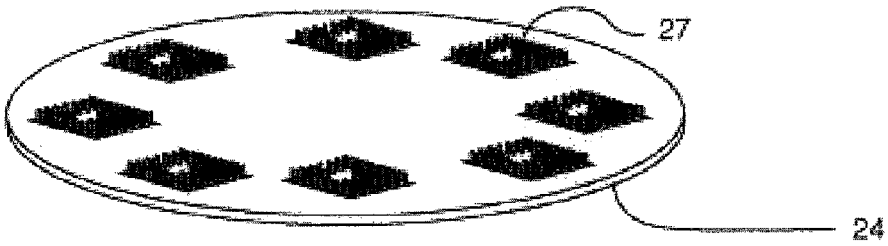
FIG. 1B is a perspective view of the underside of a disc containing directionally oriented members for rotating the disc when in contact with a vibrating tray surface and a spaced section of directionally oriented members.

Referring again to FIG. 1A, the cube 26 will move in accordance with the frequency and amplitude of the speaker diaphragm 16A acting on the vibrating tray 18. The disc 24 located on the tray 18 for movement with respect thereto is shown in its upside down position in FIG. 1B. The disc 24 is provided with circumferentially spaced sections 27 of directional members that are oriented to transmit the sonic motion of the speaker to rotate the disc 24 relative to the tray 18. In this particular embodiment there is shown secured angled bristles 28 of a velour type material secured to the bottom of the disc 24. Specifically, there is shown a circumferentially spaced group of directional members 28 that are oriented to rotate the disc 24 when disposed adjacent the vibrating tray 18. The speaker 16 can be operated at subsonic frequencies on the order of 20-120 hertz all the way up to 400 hertz which allows the speaker diaphragm 16A to vibrate in such a way to cause the cube 26 to move relative to the tray 18 and the disc 24 to rotate when in contact with the vibrating tray 18. These are but preferred frequencies and the invention is not limited thereto. The sound will control the speed at which the items are moved and if the movement of the items are to be restricted they can be tethered to the surface on which they are placed.

In essence, depending on the signal the speaker 16 receives from the microprocessor 12 or other input the speaker 16 will create vibrations in the speaker diaphragm 16A that will produce sound for the enjoyment of the user as well as a mechanical movement to move various items relative thereto. The items will move to the rhythm of the sound.

We turn now to FIGS. 2A-2F that illustrate a variety of other objects positioned on a vibrating tray 30. These are but representative of numerous objects that can be moved in response to the vibrations emanating from a speaker. All of those illustrated receive a signal from a microprocessor 12 powered by current from a battery pack 14.

Referring first to FIG. 2A we see a system similar to FIG. 1A in which there is shown a vibrating tray 30 on which is located cube 26. Also illustrated are speaker 16, speaker diaphragm 16A, speaker tray connector 20, battery pack 14 and the microprocessor electronics package 12.

FIGS. 2B through 2F show a number of different iterations of the cube 26 shown on FIG. 2A.

FIG. 2B illustrates an isometric view of a lateral action cube 26 that includes outwardly oriented directional members 28 attached to the four angled blocks 32 secured to the inner surface of the bottom wall of the lateral action cube 26. A large sphere 34 is supported on the outwardly extending directional members 28 secured to the angled surface of the blocks 32. When current from battery pack 14 for the microprocessor electronics package 12 is supplied from an on/off switch 15 or a momentary contact switch (not shown) the microprocessor 12 sends a signal to the speaker 16 that causes the speaker 16 to create vibrations in the speaker diaphragm 16A. This vibration is transmitted from the speaker diaphragm 16A through the speaker tray connector 20 and vibration tray 30. When lateral action cube 26 is placed on the vibrating tray surface 30 the vibrations are imposed on the outwardly oriented directional members 28 on the inclined surfaces of the blocks 32 to move the large sphere 34 towards the inside of the walls of lateral action cube 26 and/or rotate the sphere 34 relative to the cube 26.

In FIG. 2C there is shown a large hollow cube 36 that contains various sized spheres 38 that interact with each other and with plate 40 that is secured to the inward bottom surface of the cube 36. On the upper surface of plate 40 are directional members 28 that in response to the frequency and amplitude of the vibrating plate 40 on which the spheres 38 are located moves the spheres 38 around within the cube walls.

FIG. 2D illustrates a cube 42 that contains a large sphere 34 and circumferentially oriented directional members 44 located on the inside surface of the ring 46 secured to the inside bottom wall of cube 42. When the cube 42 is placed on the vibrating tray surface 30 the large sphere 38 is rotated inside the cube 42 by the circumferentially directed members 44.

FIG. 2E discloses a cube 48 that contains an animal FIG. 50 that is secured to plates 52 having outwardly disposed surfaces containing directional members 28. The directional members are oriented as shown in FIG. 2E[1] and when exposed to a vibrating surface the outwardly extending directional members rotate the FIG. 50 inside the cube 48.

The embodiment shown in FIG. 2F discloses a partially liquid filled cube 54. The water or other liquid 56 located therein will move relative thereto in a wave pattern when the cube is placed on a vibrating surface 30.

The FIGS. 3A and 3B illustrate an open and closed greeting card or book respectively embodying applicants invention. FIG. 3A is an isometric view of the card 58 in the open position whereas FIG. 3B is a view showing the detail of the speaker and disc interaction.

The speaker 16 that creates the sonic motion is attached to the back cover of the card 58 and the speaker 16 is activated by the electronic package 12 using current from battery pack 14. In FIG. 3B the speaker surface 16A is connected to a speaker connector 60 that is in turn connected to the vibration disc 62. Mounted directly above vibration disc 62 is a rotating disc 64 that has on its bottom surface circumferentially oriented directional members 66. The disc 64 is held in place by pin 63 and could contain graphics if desired. When the card 58 is opened a momentary contact switch 17 allows current to flow from battery pack 14 to electronics package 12 to send a signal to speaker 16. The activation of the speaker 16 to emit a selected message causes the speaker diaphragm surface to vibrate and move the speaker connector 60 and vibration disc 62 which results in the circumferentially oriented members 66 rotating the disc 64.

Figure 4:
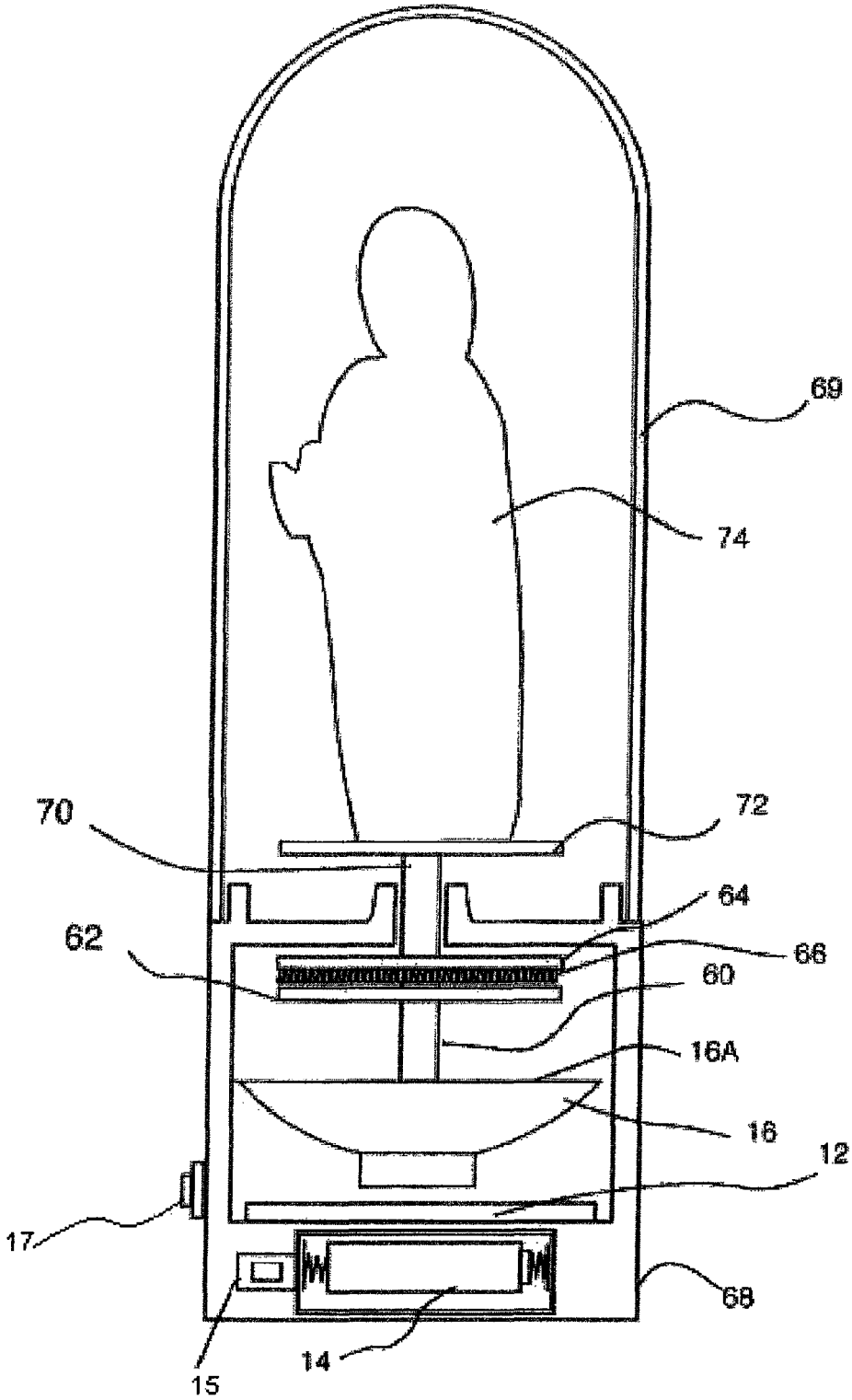
FIG. 4 shows a holiday ornament rotated by a vibrating speaker.

In FIG. 4 there is shown a cross-sectional view of a stand alone sonic motion ornament 68 located within a dome 69. Power for the sonic motion ornament 68 is either supplied from battery pack 14 or from a low voltage Christmas light connection (not shown). The ornament can be turned on by the on-off switch 15 or a momentary switch 17 could be used.

When current is supplied to the microprocessor electronics package 12, a signal is supplied to speaker 16. The speaker surface 16A vibrates the speaker connector 60 and associated vibration disc 62. The vibration disc 62 transmits the sonic movement to the circumferentially oriented material-members 66 and attached disc 64 to rotate. Connected to disc 64 is a pin 70 that rotates along with disc 64. Pin 70 transmits rotary motion up to figure disc 72. Secured to the figure disc 72 is the FIG. 74 which is inside dome 69. The user of the Christmas ornament can see the FIG. 74 rotate and enjoy the sound from the speaker 16.

While in this embodiment there is shown a rotating plate 72 with an ornament 74 placed thereon there can be a plurality of strategically placed figures having directional members connected thereto responding to the speaker vibrations. This could include bumper cars on plates having depending directional fibers that would be designed to rotate and/or move laterally over a vibrating surface as well as figures that in response to sonic vibrations will spar with each other such as in a star wars type fight. The variations are essentially limitless and only restricted by the imagination of the creator.

Figure 5:
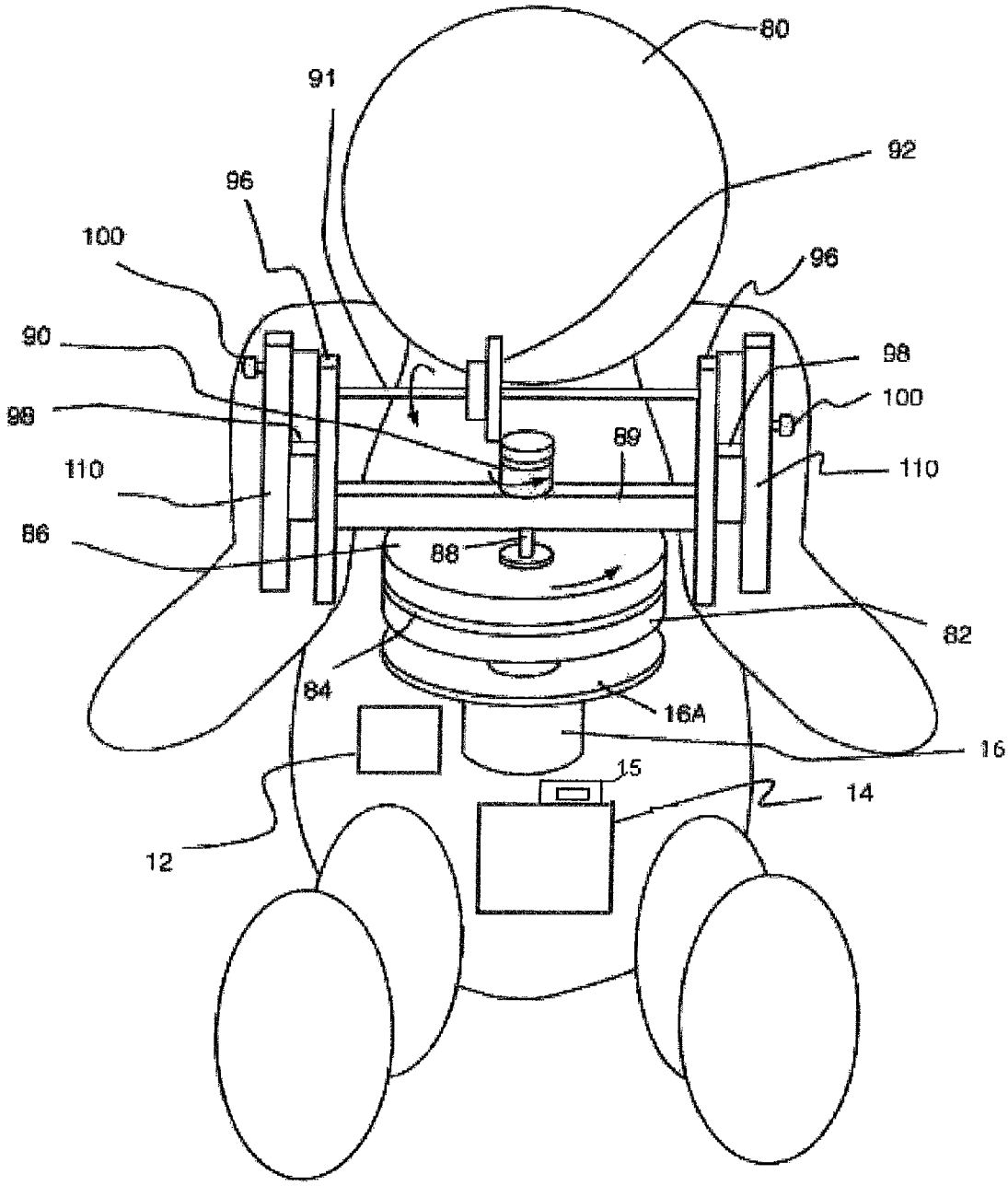
FIG. 5 shows a doll whose arms are moved up and down by the sonic assembly.

FIG. 5 shows the utilization of sonic motion to operate the arms of a character 80. The isometric view of character 80 includes a speaker 16, battery pack 14 and microprocessor electronics package 12. An on-off switch 15 is used to turn the character on or off. The sonic motion from the speaker 16 drives the vibration disc 82. The vibration disc 82 imparts sonic motion to the circumferentially oriented members 84 connected to disc 86 to rotate the disc 86. Connected to the disc 86 is centrally oriented pin 88 that extends through the crank mechanism support structure 89. The pin 88 connects to the drive pinion 90 that in turn drives crown gear 92. The crown gear 92 rotates crown shaft 94 that drives arm crank 96. When current is supplied from battery pack 14 to microprocessor electronics package 12 to supply a signal to speaker 16 the speaker diaphragm surface 16A vibrates speaker connector (not shown) and vibration disc 82. This causes the rotation of the circumferentially oriented material members 84 along with rotating disc 86 and centrally oriented pin 88. The motion is transferred through crank action support structure 89 to pinion 90. Pinion 90 in turn interacts with crown gear 92 to rotate crown shaft 94 which is connected to arm crank 96 which has an offset pin 100 that rides in a slot (not shown) in arm 110 to cause arm 110 to swing in an arc about arm pivot pin 98.

Figure 6:
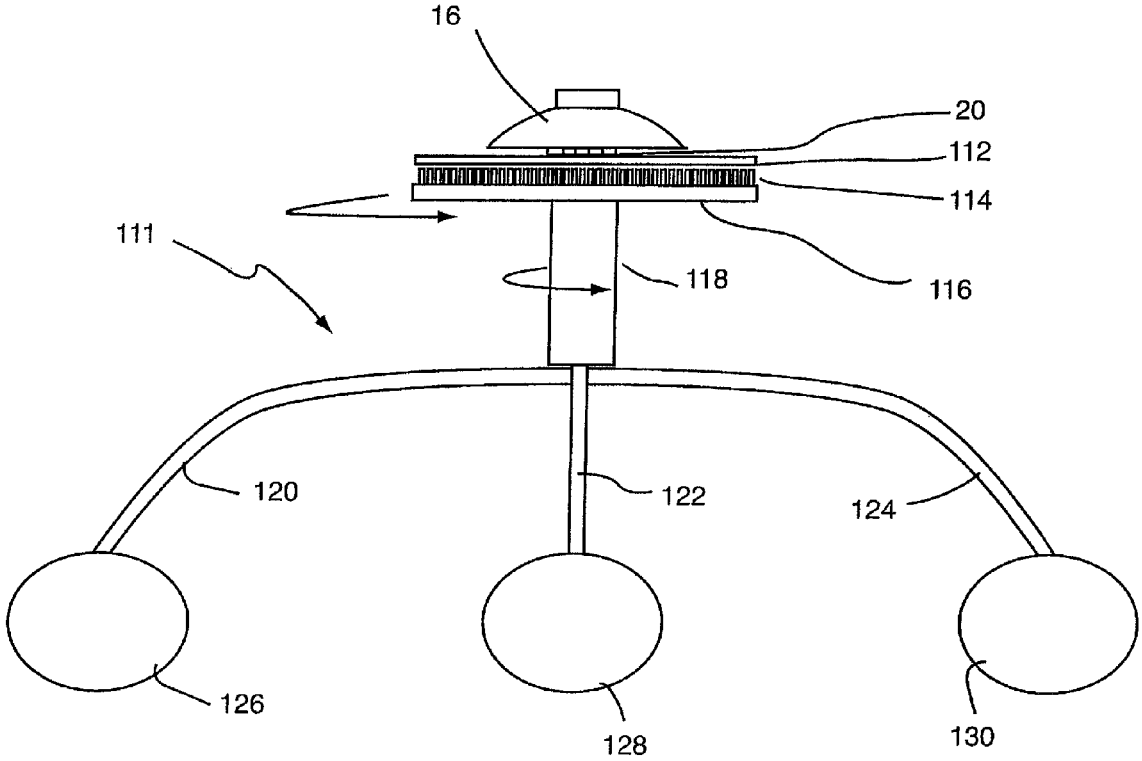
FIG. 6 is a mobile operated by a speaker.

In FIG. 6 there is shown a crib mobile 111 that is powered by sonic motion from a speaker 16 through a speaker connector 20 to a vibrating disc 112. The sonic motion of the vibrating disc 112 is imposed on the angled directional fibers 114 secured to a rotating disc 116. Depending from the disc 116 is a rod 118 from which hangs three arms 120, 122 and 124. Depending from the ends of arms 120, 122, 124 are three attractive members 126, 128, 130 that provides entertainment to someone lying in the crib.

Turning now to FIGS. 7A and 7B there is illustrated the plan and side views of a toy vehicle 150. Centrally located within the vehicle 150 is a speaker 16 that has a speaker surface 16A that vibrates and transmits vibration to circumferentially oriented members 66 depending from the crank plate 152 on which is located the upwardly extending crank pin 154 that is eccentrically located relative to the axis of crank plate 152. The vibrations to the member 66 act to rotate the crank plate 152. The crank pin 154 rides in a slot 156 in crank follower 158. The crank follower 158 is pivotally connected to a pivot pin 160 extending upwardly from a member 162 connected to the toy vehicle 150. Connected to the free end of the crank follower 158 are a pair of eyes 164. The crank follower 158 rotates around the follower pivot 160. When the speaker is activated the crank plate 152 is rotated and carries with it the crank pin 154 that moves in the slot 156 and engages the crank follower 158 to pivot it about pin 160. The crank follower oscillates back and forth to move eyes 164 on the end of the crank follower from side to side. To complete the description of the assembly in FIG. 7A it is noted that the power therefore is provided by the batteries 14 located in the vehicle which powers the sound electronics that could be a microprocessor 12 or a radio to provide signals for the vibration generating device which in the illustrated embodiment is a speaker 16.

FIGS. 7C and 7D are similar to FIGS. 7A and 7B but instead of the eyes 164 being moved the engine 166 is tilted from side to side as the crank follower 158 is oscillated by the crank pin 154.

Figure 8A:
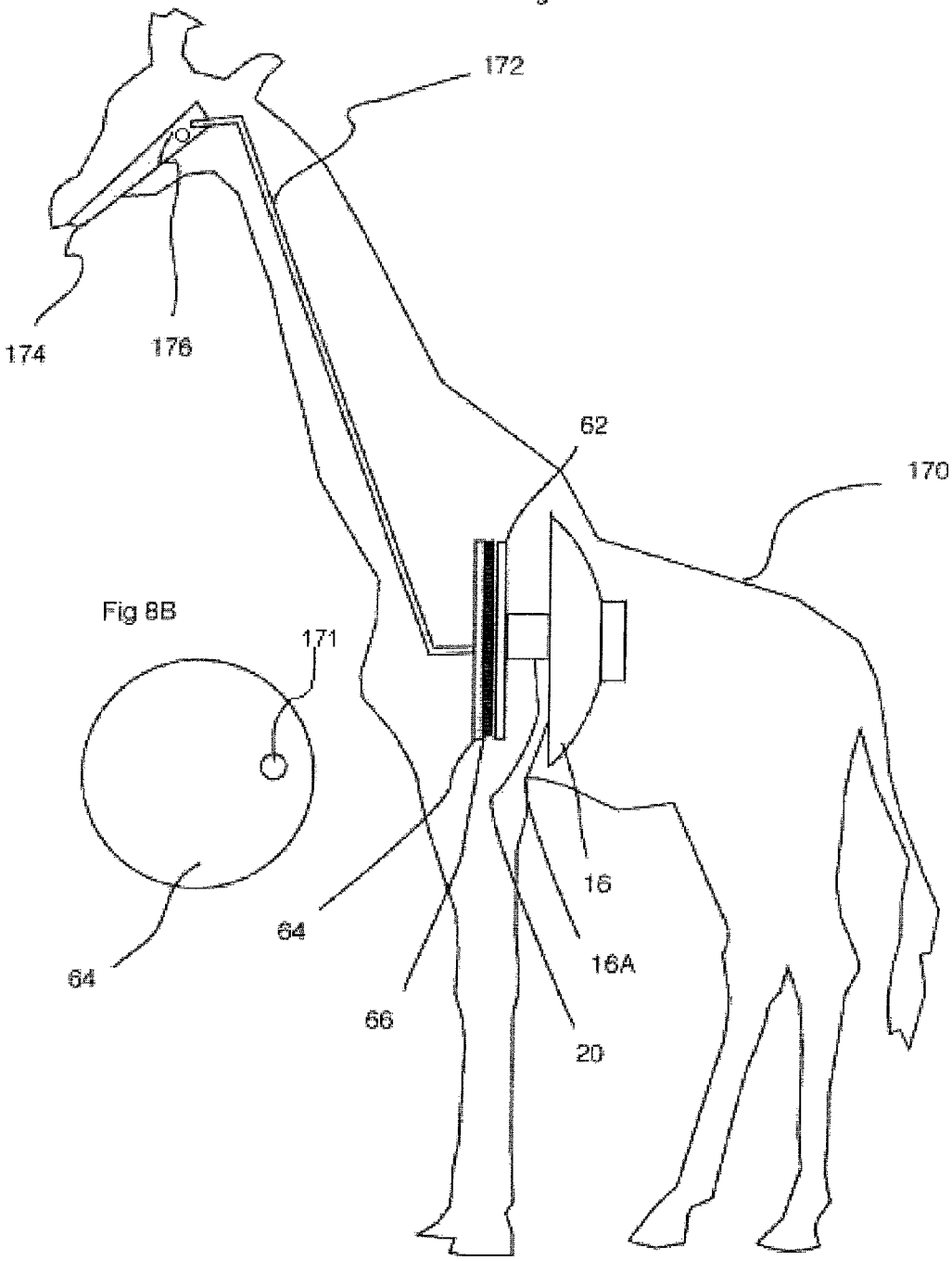
FIG. 8A is a cross-sectional view of a giraffe in which the lower jaw of the giraffe is moved in response to the movement of a speaker diaphragm.

In FIG. 8A there is shown a profile view of an animal 170 which in this case is a giraffe that has a vibration generating member shown here as a speaker 16 located in the abdomen of the giraffe 170. The speaker 16 has a speaker surface 16A that has a speaker connector 20 that transfers the vibration from vibration generating members to the vibration disc 62. The disc 64 contains, extending circumferentially oriented members 66 disposed adjacent vibration disc 62 that transfers the circular motion to disc 64 to move link 172. Link 172 is connected to lower jaw 174 which pivots around jaw pivot 176. FIG. 8B is a front view of the disc 64 showing an opening for link 172.

Figure 9:
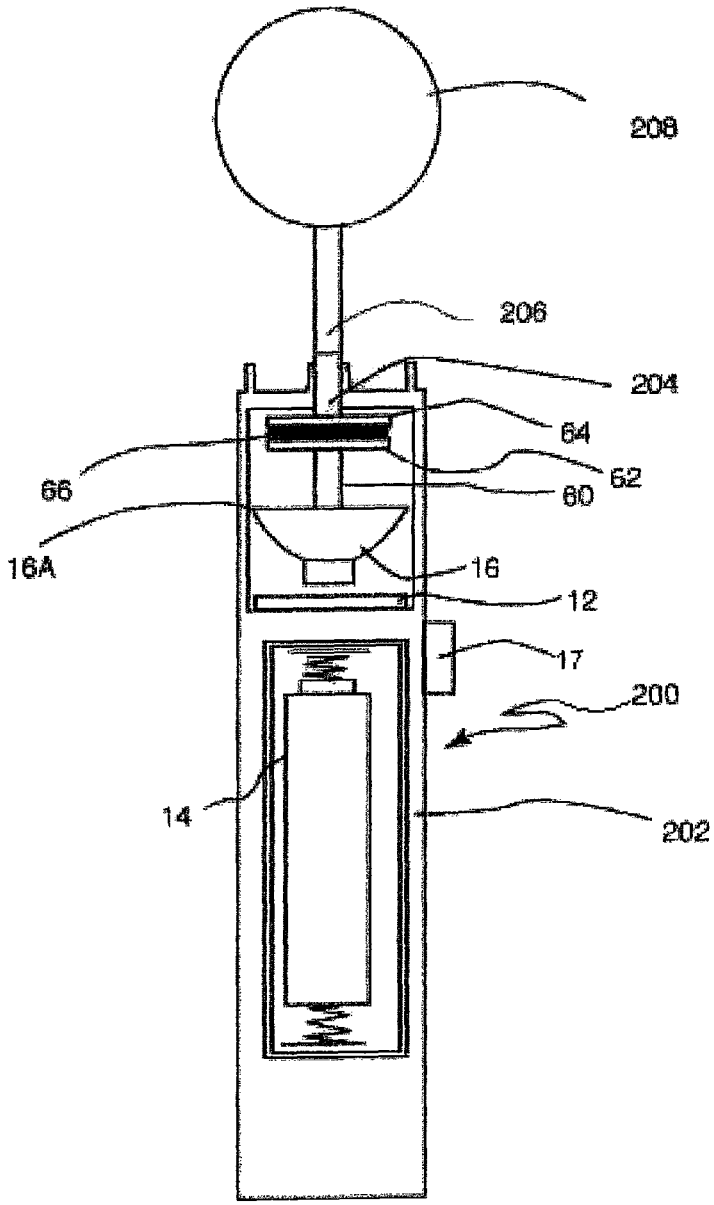
FIG. 9 discloses another embodiment of a sonically operated lolly pop holder similar in operation to the stand alone sonic motion device in FIG. 4.

In FIG. 9 there is illustrated a sonic motion pop holder assembly 200 that includes a vibration generating arrangement including a speaker 16 located in the handle 202 thereof. The speaker has a speaker surface 16A and a speaker connector 60 which transfers the vibration from vibration generating member shown here as speaker 16 to the vibration disc 62. The circumferentially oriented material members 66 is disposed adjacent disc 62 and transfers the circular motion to rotation plate 64 to which is connected the lolly pop holder 204 that rotates therewith. The holder 204 has a receptacle for the lolly pop stick handle 206 to which the candy portion 208 of the pop is connected.

To rotate the lolly pop the child presses the momentary switch 17 and the battery 14 supplies current to the sound electronics 12 which provides a signal to speaker 16. The lolly pop is rotated by the action of the circumferentially oriented members 66 interaction with the disc 64. When the child places the pop in their mouth the rotation may slow down or stop but the child can still hear the sound being produced by the speaker 16.

Figure 10B:
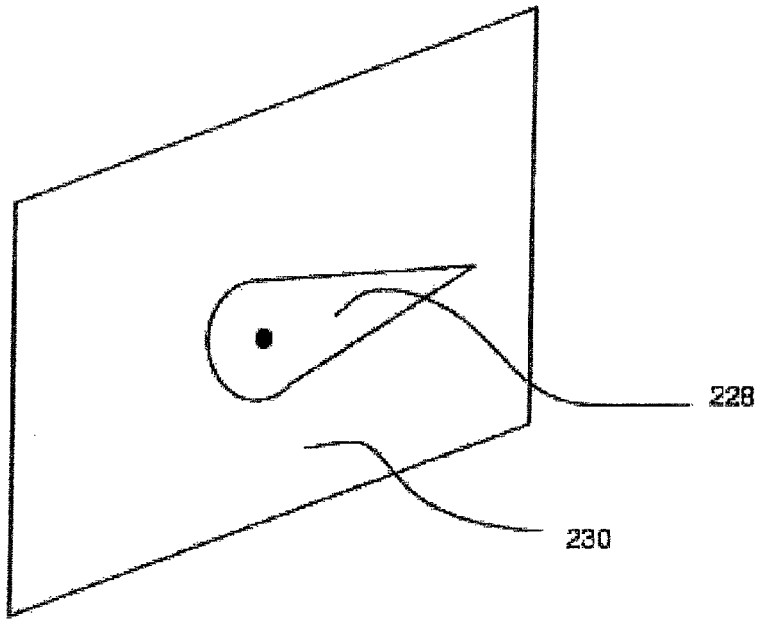
FIG. 10B illustrates a game spinner device similar to FIG. 10A in which an arrow is used in place of the figure.
Figure 10A:
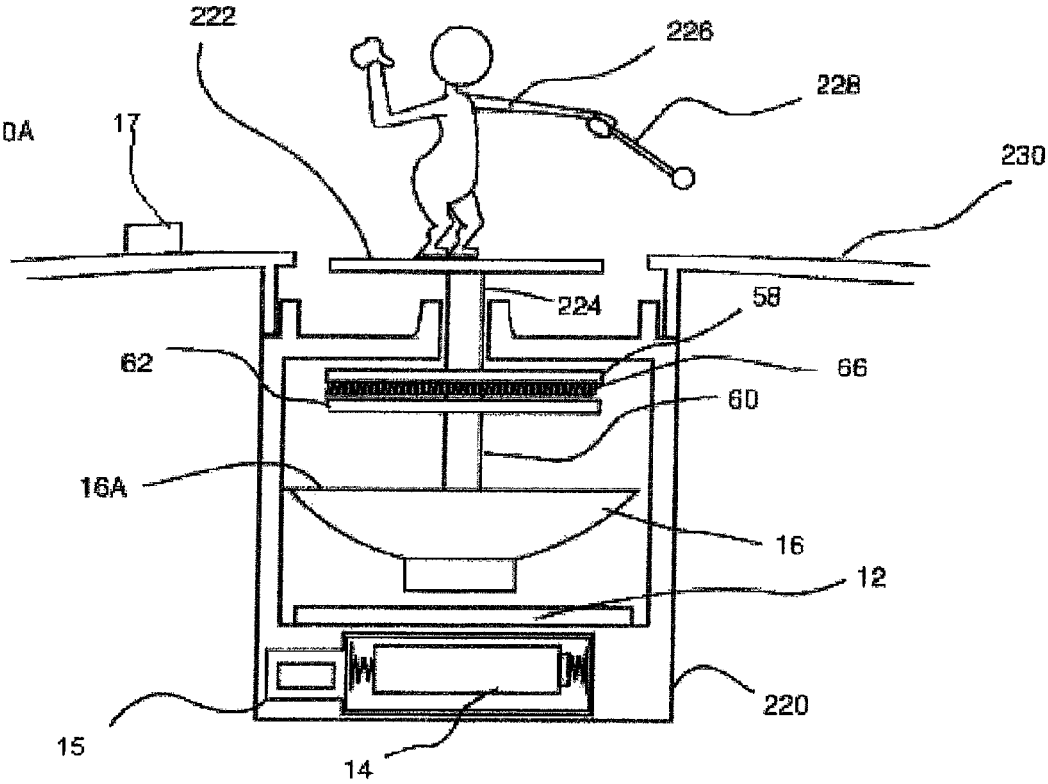
FIG. 10A illustrates a figure directed game spinner device using sonic motion generated by a speaker.

FIG. 10A illustrates a cross-sectional view of a game spinner 220 that is activated by a vibration generating member consisting of a speaker 16 by the action of a speaker surface 16A. The vibration of the speaker surface 16A is transferred to the vibration disk 62 through a speaker connector 60. Located above the vibration disk 62 is the circumferentially oriented member 66 which transfers the circular motion of the member 66 to the rotation plate 58. The rotation plate 58 is connected to the figure plate 222 through a shaft 224. The spinner figure 226 is connected to the rotation plate 58 and has a pointer 228 that rotates above spinner graphics 230 to indicate game play.

A momentary switch 17 for battery 14 when pressed supplies current to sound electronics 12 which provides a signal to speaker 16. Thus, the spinner figure 226 is rotated by the action of the circumferentially oriented member 66 with the disk 58.

In FIG. 10B there is illustrated an embodiment similar to the one shown in FIG. 10A in which the spinner figure 226 is replaced with the arrow type pointer 228 that is connected to the shaft 224.

It is intended to cover by the appended claims all embodiments that fall within the true spirit and scope of the invention.

The invention claimed is:

1. A sonically operated assembly consisting of a speaker having a vibrating surface, power for operating said speaker, a power operated programmer for controlling the frequency and amplitude of the speaker surface, support means for holding at least one object to be activated by said speaker surface, said object and support means define adjacent surfaces and one of the adjacent surfaces include directionally oriented members that will move the object relative to said support means depending on the orientation of said members.

2. A sonically operated assembly as set forth in claim 1 in which the directional members on an object on the support means is located in a parallel direction whereby the object will move in a lateral direction relative to the support means.

3. A sonically operated assembly as set forth in claim 1 in which an object on said support means contains members in contact with the support means that are circumferentially disposed whereby the object will rotate relative to the support means.

4. A sonically operated assembly in accordance with claim 1 in which one of the objects on said support means contains members that are angularly directed whereby the object will rotate as well as move laterally.

5. A sonically operated assembly as set forth in claim 1 in which the object on the support means comprises a cube containing on its bottom surface directionally oriented members that moves the object in response to the sonic output of the speaker surface.

6. A sonically operated assembly in accordance with claim 5 in which the cube is hollow and contains a ring in its bottom and a sphere located thereon, the ring surface defining on its inner surface directional fibers that are oriented to rotate the sphere relative to said ring.

7. A sonically operated assembly in accordance with claim 5 in which the cube is hollow and contains discs on its opposite inner surfaces, a figure secured to said discs, the discs containing directional members on its outer surfaces which when in contact with a plate that responds to the vibrations emanating from the speaker will rotate the cube and figure therein.

8. A sonically operated assembly consisting of a speaker assembly having a vibrating surface, power for operating said speaker, a power operated microprocessor for controlling the frequency and amplitude of the speaker surface, a disc disposed adjacent said speaker surface, the bottom of the disc contains circumferentially disposed members that rotates said disc in response to the action of the speaker surface, connected to the disc is a shaft, rotated by said disc, connected to said shaft is a mechanism that comprises a plate for supporting an ornament so that the ornament rotates with said plate.

9. A sonically operated apparatus as set forth in claim 8 in which the mechanism connected to said shaft comprises a plurality of supports for figures or the like to define a rotating mobile.

10. A sonically operated assembly as set forth in claim 8 in which the disc is part of an assembly comprising a first disc connected to the speaker surface by a connector to move in conjunction with the speaker surface, a second disc disposed adjacent said first disc and containing circumferentially disposed directional members that will rotate the second disc in response to the speaker" vibrations, an axially disposed shaft extending outwardly of said second disc and members connected to said shaft for rotating therewith.

11. A sonically operated apparatus as set forth in claim 10 in which the mechanism connected to the shaft comprises a holder for a lolly pop whereby rotating the shaft rotates tile lolly pop.

12. A sonically operated apparatus as set forth in claim 10 in which the mechanism connected to said shaft comprises a plate supporting a figure having a pointer and a surface disposed adjacent thereto contains graphics whereby the apparatus will serve as a game spinner.

13. A sonically operated assembly as set forth in claim 8 in which the speaker is secured to a model car having a car body and engine and tile shaft secured to said disc is eccentrically disposed relative to the disc and the members engaged by said shaft comprises a follower pivoted to the car body at one end and having a flee end containing eyes secured thereto whereby the eyes will move in response to the movement of said disc.

14. A sonically operated assembly as set forth in claim 12 in which the free end of the follower is connected to said engine and thus movement of said follower will tilt the engine.

15. A sonically operated assembly in accordance with claim 11 in which the shaft is eccentrically disposed and is located within an animal having a pivotally moveable jaw member, and linkage connected to the pivotally mounted jaw member and eccentric shaft whereby the jaw will move in response to the rotating disc.

16. A sonically operated apparatus as set forth in claim 10 in which the mechanism connected to the shaft comprises a pointer and a surface disposed adjacent thereto contains graphics whereby the apparatus will serve as a game spinner.

* * * * *